US006272691B1

(12) United States Patent
Henricksen et al.

(10) Patent No.: US 6,272,691 B1
(45) Date of Patent: Aug. 14, 2001

(54) METHOD AND APPARATUS FOR HOLDING A SLEEVE

(75) Inventors: Douglas A. Henricksen, Blaine, MN (US); Sandra J. Shidler, Highland Village, TX (US)

(73) Assignee: Promarx, Inc., Flower Mound, TX (US)

( * ) Notice: Subject to any disclaimer, the term of this patent is extended or adjusted under 35 U.S.C. 154(b) by 0 days.

(21) Appl. No.: 09/657,953

(22) Filed: Sep. 8, 2000

(51) Int. Cl.[7] ..... A41B 1/08
(52) U.S. Cl. ..... 2/338; 2/311; 2/126
(58) Field of Search ..... 2/125, 126, 920, 2/289, 270, 321, 311, 312, 317, 338, 170, 171, 113, 115, 69, DIG. 11, 114; 24/306, 442; 132/248

(56) References Cited

U.S. PATENT DOCUMENTS 233,414 * 10/1880 Hays ..... 2/338
3,086,529 * 4/1963 Munz et al. ..... 2/338
3,426,363 * 2/1969 Girard ..... 2/338
4,273,130 * 6/1981 Simpson ..... 606/203
4,384,583 * 5/1983 Speelman et al. ..... 606/203
4,475,252 * 10/1984 Peyser et al. ..... 2/125
5,548,871 * 8/1996 Trethewey ..... 24/16 R
5,787,511 * 8/1998 Garside ..... 2/269
6,081,925 * 7/2000 Reiber ..... 2/125

* cited by examiner

*Primary Examiner*—Gloria M. Hale
(74) *Attorney, Agent, or Firm*—H. Dennis Kelly

(57) ABSTRACT

A sleeve is held in a gathered postion with an elongated strap having an elastic loop on one end and a fastener on the other end. The fastener is passed through the loop and then folded back against itself to hold the fastener to the loop. The sleeve holder may also have one or two labels to add decorative graphics to the device.

13 Claims, 2 Drawing Sheets

METHOD AND APPARATUS FOR HOLDING A SLEEVE

BACKGROUND OF THE INVENTION

1. Field of the Invention

This invention relates in general to clothing accessories. In particular, the invention relates to a method and apparatus for holding a sleeve bunched together to keep the sleeve from interfering with the activities of the garment wearer.

2. Description of Related Art

It has become common for soccer players and other sports participants to gather the sleeves of their garments. Several devices have been used to secure the sleeves in a gathered position, so that the sleeves do not fall during play. One such device is shown in U.S. Pat. No. 6,081,925, issued Jun. 4, 2000, to Reiber. That device comprises a strap having one fastening means at one end and a second fastening means at the other end. The strap is wrapped around the gathered sleeve, and the two fastening means are connected to one another to secure the strap in place. The two fastening means are located on opposite sides of the strap, and at opposite ends of the strap. The device also has a label attached to one side of the strap.

SUMMARY OF THE INVENTION

The general object of the method and apparatus of the invention is to secure a sleeve of a garment in a gathered position. In general, this object is accomplished by a sleeve holder for holding a sleeve of a garment in a gathered position. The sleeve holder has an elongated strap of material having first end and a second end. An elastic loop is attached to the first end of the strap, and a fastener attached to the second end of the strap passes through the loop, folds against itself, connecting the fasteners, securing the folded end to the loop. The above, as well as additional objects, features, and advantages of the invention will become apparent in the following detailed description.

DESCRIPTION OF THE PREFERRED EMBODIMENT

Figure 1:
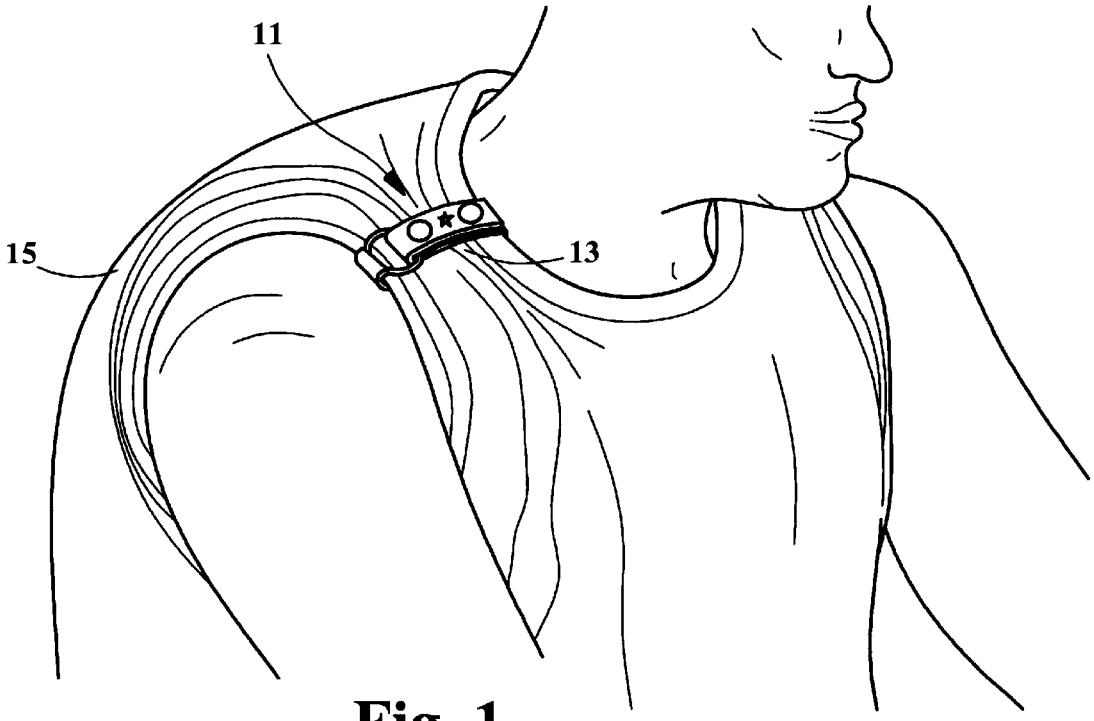
FIG. 1 is a perspective view of a sleeve holder holding a sleeve of a garment in a gathered position.
Figure 5:
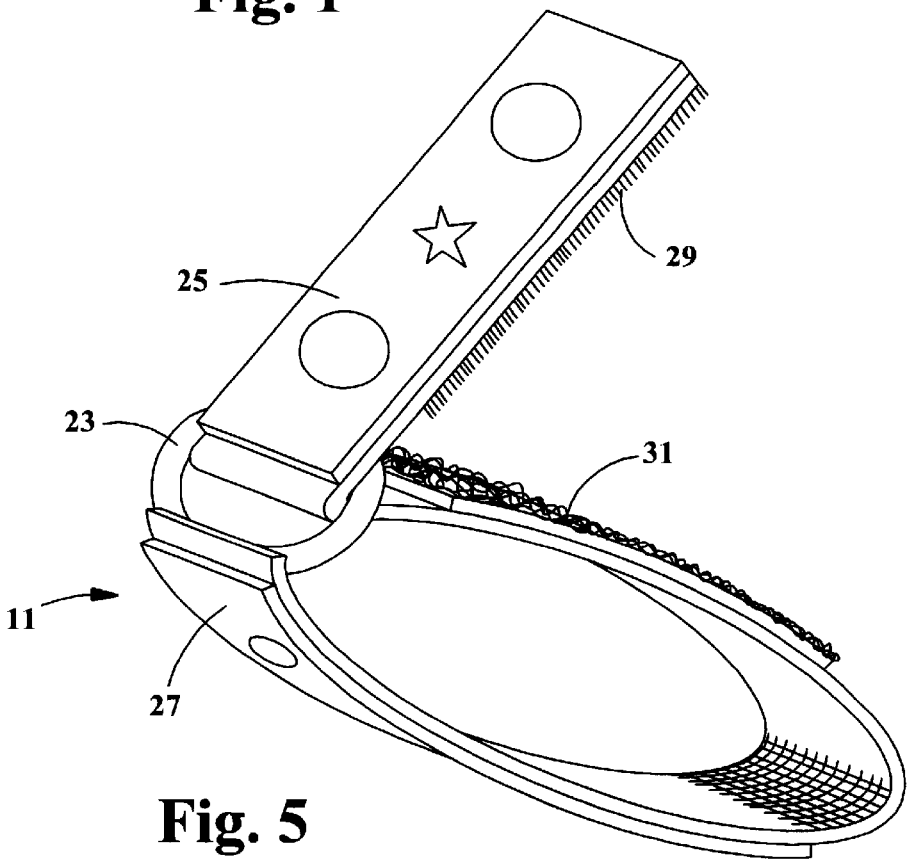
FIG. 5 is a perspective view of the sleeve holder partially connected, with one end of the strap inserted through the loop.
Figure 2:
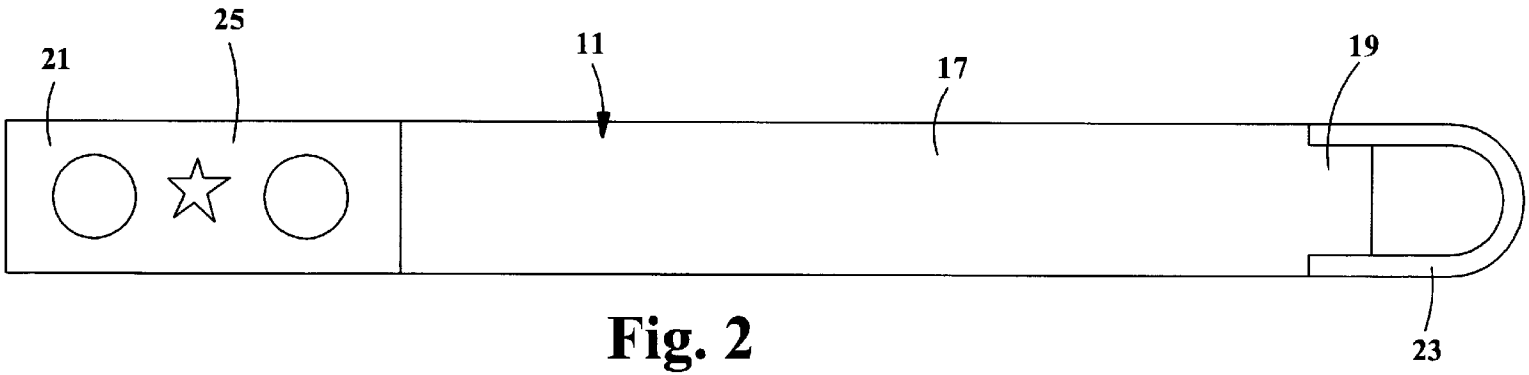
FIG. 2 is a top plan view of the sleeve holder laid out flat.
Figure 3:
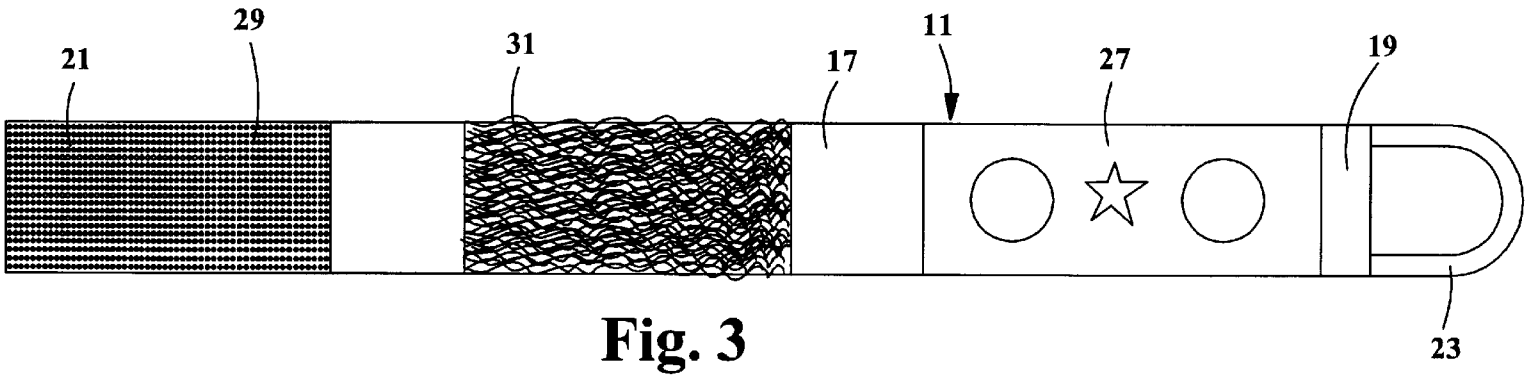
FIG. 3 is a bottom plan view of the sleeve holder laid out flat.
Figure 4:
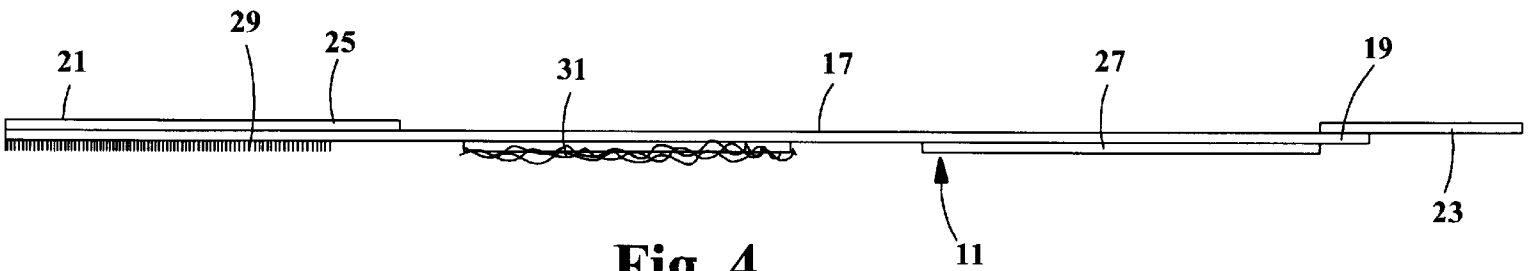
FIG. 4 is a side elevation of the sleeve holder laid out flat.

As shown in FIG. 1, the sleeve holder 11 of the invention is used to hold a sleeve 13 of a garment 15 in a gathered position. The sleeve 13 is gathered up so that it lies atop the shoulder, rather than along the arm. This allows freer arm movement for the wearer of the garment 15. FIGS. 2–4 show the sleeve holder 11 prior to installation. The sleeve holder 11 has an elongated strap of material 17 having a first end 19 and a second end 21. The strap 17 is preferably made of polypropylene, but there are a large number of acceptable materials. The strap 17 is about seven inches long and about one inch wide and about one sixteenth of an inch thick. A piece of elastic material, about two inches long, is attached to the first end 19 of the strap 17 to form a small loop 23.

The loop 23 may be sewn or otherwise attached to the first end 19 of the strap 17.

A first label 25, preferably made of 65% cotton and 35% polyester, is sewn onto the top of the strap 17. The first label 25 is about one inch wide and about two inches long. The label 25 may have graphics, such as pictures of soccer balls or such, in order to make the sleeve holder 11 more attractive.

A second label 27 may be sewn onto the strap 17 on the bottom, as shown in FIG. 3. The second strap is made of the same material as the first label 25, is about one inch wide and about three inches long, and may also have graphics. When the sleeve holder 11 is installed, the second label 27 is on the opposite side of the strap 17 from the first label 25.

Also sewn onto the bottom of the strap 17 is a first fastener 29 and a second fastener 31. The first fastener 29 is about one inch wide and about one and a half inches long. It is sewn onto the strap 17 at the second end 21 of the strap 17.

There is about one inch between the first fastener 29 and the second fastener 31. The second fastener 31, like the first 29, is about one inch wide and one and a half inches long. The two fasteners 29 and 31 are preferably cooperating hook and loop fasteners, although, of course, they might also be some other type of fasteners.

There are two common ways to use the sleeve holder 11 of the invention. One is to first gather the sleeve 13 of the garment 15. Then, the strap 17 is placed around the gathered sleeve 13. The strap 17 is placed under the gathered sleeve 13, with the bottom of the strap 17 downward, against the shoulder. The second end 21 of the strap 17 is inserted through the loop 23. The second end 21 of the strap 17 is then folded against itself to enclose the loop 23. Fasteners 29 and 31 are connected, attaching the folded end 21 of the strap 17 to the strap 17, securing the folded end 21 of the strap 17 to the loop 23.

Another way to use the sleeve holder 11 is to use the strap 17 to gather the sleeve 13. The strap 17 is placed through the garment 15 and wrapped around to gather the sleeve 13. The second end 21 of the strap is then inserted through the loop 23. The second end 21 of the strap 17 is folded against itself to enclose the loop 23. Fasteners 29 and 31 are connected, attaching the folded end 21 of the strap 17 to the strap 17, securing the folded end 21 to the loop 23.

The method and apparatus of the invention have several advantages over the prior art. The sleeve holder 11 is safer than the devices of the prior art, since the elastic loop 23 gives the device some elasticity. This allows the sleeve holder 11 to give a little when another person accidentally catches a finger in the sleeve holder 11. Also, the sleeve holder 11 is more secure, and it is more difficult for the sleeve holder 11 to be accidentally pulled off of the sleeve 13. This is a safety feature, as well, because a sleeve holder 11 lying on the field of play can be stepped on, causing a slip or a fall. Further, the sleeve holder 11 is easier to securely attach to the sleeve 13, since the loop 23 causes the two fasteners 29 and 31 to be aligned with one another, making full contact between the two fasteners 29 and 31 easier. The elastic loop 23 on the sleeve holder 11 also makes the sleeve holder 11 more comfortable than the prior art, since the sleeve holder 11 can give with the movements of the garment wearer. Finally, the sleeve holder 11 can be made more attractive than the prior art, for several reasons. First, the loop 23 forces the two fasteners 29 and 31 to align with one another. Second, the two fasteners 29 and 31 are closer to one another, rather than being at opposite ends of the strap 17. Third, strap 17 is folded between the two fasteners 29 and 31, where the strap 17 is narrow and there is no label. Finally, the sleeve holder 11 provides two labels 25 and 27, so that two different graphics can be put on the same sleeve holder 11, giving the wearer a choice of which graphics to show.

The invention has been described in only one embodiment. It should be apparent to those skilled in the art that the invention is not so limited, but is susceptible to various changes and modifications without departing from the spirit of the invention.

What is claimed is:

1. A sleeve holder for holding a sleeve of a garment in a gathered position, wherein the sleeve holder comprises:

an elongated strap of material having a first end and a second end and having a top and a bottom;

an elastic loop attached to the first end of the strap;

a first fastener attached to the bottom of the strap at the second end of the strap; and a second fastener attached to the bottom of the strap, separated from the first fastener by a section of the strap.

2. A sleeve holder as recited in claim 1, wherein the second fastener is separated from the first fastener by a section of about one inch.

3. A sleeve holder as recited in claim 1, wherein the first fastener and the second fastener are made of hook and loop fastener material so that the first fastener and the second fastener cooperate to secure the second end of the strap to the elastic loop.

4. A method of holding a sleeve of a garment in a gathered position, comprising the steps of:

placing a strap around the sleeve;

folding the strap over to gather the sleeve into a gathered position;

inserting one end of the strap through a loop attached to the other end of the strap;

folding the end of the strap over against itself to enclose the loop; and attaching the folded end of the strap to the strap to secure the folded end of the strap to the loop.

5. A method of holding a sleeve of a garment in a gathered position, as recited in claim 4, wherein the strap is made of polypropylene and the label is made of a cotton and polyester mix.

6. A method of holding a sleeve of a garment in a gathered position, comprising the steps of:

gathering the sleeve of the garment;

placing a strap of material around the gathered sleeve;

inserting one end of the strap through a loop attached to the other end of the strap;

folding the end of the strap over against itself to enclose the loop; and attaching the folded end of the strap to the strap to secure the folded end of the strap to the loop.

7. A method of holding a sleeve of a garment in a gathered position, as recited in claim 6, wherein the strap is made of polypropylene and the label is made of a cotton and polyester mix.

8. A sleeve holder for holding a sleeve of a garment in a gathered position, wherein the sleeve holder comprises:

an elongated strap of material having a first end and a second end;

an elastic loop attached to the first end of the strap; and a fastener attached to the second end of the strap for fastening the second end of the strap to the loop.

9. A sleeve holder as recited in claim 8, wherein the strap has a first side and a second side, and wherein the fastener further comprises a pair of cooperating members for fastening the second end of the strap to the loop after the second end of the strap has been inserted through the loop and folded back against the strap.

10. A sleeve holder as recited in claim 9, wherein the cooperating members are straps of hook and loop fastener material.

11. A sleeve holder as recited in claim 9, further comprising a label attached to one side of the strap.

12. A sleeve holder as recited in claim 11, wherein the strap is made of polypropylene and the label is made of a cotton and polyester mix.

13. A sleeve holder as recited in claim 12, further comprising a second label attached to the side of the strap opposite from the first label.

* * * * *